US005896768A

United States Patent [19]

Cranick et al.

[11] Patent Number: 5,896,768

[45] Date of Patent: Apr. 27, 1999

[54] ELECTRONIC CHILD SECURITY DOOR LOCK SYSTEM

[75] Inventors: John Cranick, White Lake; Jeffrey K. Wiersing, Walled Lake; Daniel Mittelbrun, Farmington Hills, all of Mich.

[73] Assignee: UT Automotive Dearborn, Inc., Dearborn, Mich.

[21] Appl. No.: 08/857,208

[22] Filed: May 15, 1997

[51] Int. Cl.[6] ..... E05B 63/14

[52] U.S. Cl. ..... 70/264; 200/4

[58] Field of Search ..... 70/257, 264; 200/4, 200/7, 339; 307/10.2

[56] References Cited

U.S. PATENT DOCUMENTS

| | | | |
|---|---|---|---|
| 4,117,286 | 9/1978 | Methner et al. | 200/76 |
| 4,376,237 | 3/1983 | Long | 200/61.27 |
| 5,486,669 | 1/1996 | Oshgan | 200/556 |
| 5,510,583 | 4/1996 | Pescetto | 200/1 B |
| 5,571,998 | 11/1996 | Momoi | 200/50.28 |

FOREIGN PATENT DOCUMENTS

| | | |
|---|---|---|
| 0245001A2 | 11/1987 | European Pat. Off. . |
| 0245001A3 | 11/1987 | European Pat. Off. . |
| 0368290A2 | 5/1990 | European Pat. Off. . |
| 0368290A3 | 5/1990 | European Pat. Off. . |
| 2848588A1 | 5/1980 | Germany . |
| 2275726 | 9/1994 | United Kingdom . |
| 2300973 | 11/1996 | United Kingdom . |

OTHER PUBLICATIONS

PCT Search Report dated Aug. 10, 1998 for International Application No. PCT/US98/09334 with an International Filing Date of May 7, 1998.

PCT Search Report dated Jun. 10, 1998 for International Application No. PCT/US98/03467 with an International Filing Date of Feb. 23, 1998.

*Primary Examiner*—Lloyd A. Gall
*Attorney, Agent, or Firm*—Howard & Howard

[57] ABSTRACT

The invention relates to a method and a device for selectively controlling the lock condition of the doors of a vehicle. The door lock control device includes a set of at least three switch contacts incorporated into a single switch device which allows a user to activate each contact through the use of a single handle. Closure of the three switch contacts provides the user the ability to lock all doors and to selectively unlock subsets of all the doors through the use of the single switch handle. A first switch contact is activated when the switch handle is moved in a desired direction. A second switch contact is activated when the switch handle is further moved in the same direction. A third switch contact is activated when the switch handle is moved in an opposite direction. The second switch contact includes a generally flexible conductive member supported adjacent a printed circuit board.

9 Claims, 4 Drawing Sheets

ELECTRONIC CHILD SECURITY DOOR LOCK SYSTEM

BACKGROUND OF THE INVENTION

This invention generally relates to a method and a device for controlling a vehicle door lock and, more particularly, to a method and a door lock control device capable of independently unlocking discrete subsets of doors.

A variety of switching controls are used to accomplish various tasks. In some instances, it is desirable to provide a single switch assembly which can accomplish several switching functions. One example of such a situation is within a vehicle having power door locks.

In most vehicles, power door locks are controlled by a single switch which has two functions, namely all doors locked or all doors unlocked. Power locks have benefits, however, it would be desirable to provide additional flexibility.

Specifically, it is desirable to prevent accidental unlocking of doors by children, usually involving rear doors. Current door lock systems address this concern by incorporating a mechanical anti-unlock feature in each rear door which separately prevents the rear doors from being opened from the inside. While this mechanical feature does prevent accidental opening of the rear doors, it also requires additional components. Also, the feature is not very convenient because it requires that a person manually engage or disengage the mechanical anti-unlock feature. The mechanical lock also requires a passenger in the front seat to open the door for those in the rear seat. There are many times when it is desired to allow the rear seat passenger the ability to open the rear door.

Therefore, it is desirable to provide a method and an improved door lock system that permits the user to easily accomplish selective control of the unlocking of the doors in a vehicle. This invention permits the user to selectively unlock various subsets of vehicle doors in a way that has not been available until now.

SUMMARY OF THE INVENTION

In general terms, this invention provides a unique arrangement of switch contacts which allows for selection of one of a set of at least three signals. The three signals either lock all the doors in a vehicle, unlock a first subset of doors, or unlock a second subset of doors.

Preferably, the three signals are provided by a single switch handle provided in the switching device which can be manipulated by a user. The switch handle includes a first plunger and a second plunger which selectively engage a first switch contact and a second switch contact respectively to couple the contacts with a power supply and accomplish a switching function. Each switching function occurs independently when the switch handle is moved in an appropriate direction. The switch handle also includes an actuator portion that engages a third switch contact to cause a central portion of a flexible member conductive member to flex and contact a signal generator. The contact accomplishes a third switching function. The actuator portion engages the flexible member of the third switch contact when the switch handle is moved in the same direction as it was moved to accomplish the second switching function, although moved through a further distance.

The method of the invention comprises the steps of providing a control with a user manipulatable handle to allow a user to select one of a set of input signals, the selected input signal is then sent to an electronic control, the electronic control detects the input signal and transmits an appropriate output signal to door lock modules to alter the status of a door lock button associated with each door lock module.

The invention allows a user to easily control the opening or closing of the rear doors. Thus, the user is able to control the ability of children in the rear seats to leave the vehicle. The invention eliminates the use of the mechanical interlocks preventing those in the rear seat from opening the rear doors from inside the vehicle. The mechanical interlocks required additional parts, and also did not allow the occupant of the rear seat to leave the vehicle without assistance from one outside the vehicle when the interlock was made. The present invention allows an occupant of the front seat to allow an occupant of the rear seat to leave the vehicle, if the occupant of the front seat does wish the occupant of the rear seat to leave the vehicle. As an example, when an adult is in the rear seat it may be desirable to unlock the rear locks.

These and other features and advantages of this invention will become more apparent to those skilled in the art from the following detailed description of the presently preferred embodiment. The drawings that accompany the detailed description can be described as follows.

DETAILED DESCRIPTION OF THE PREFERRED EMBODIMENT

Figure 1:
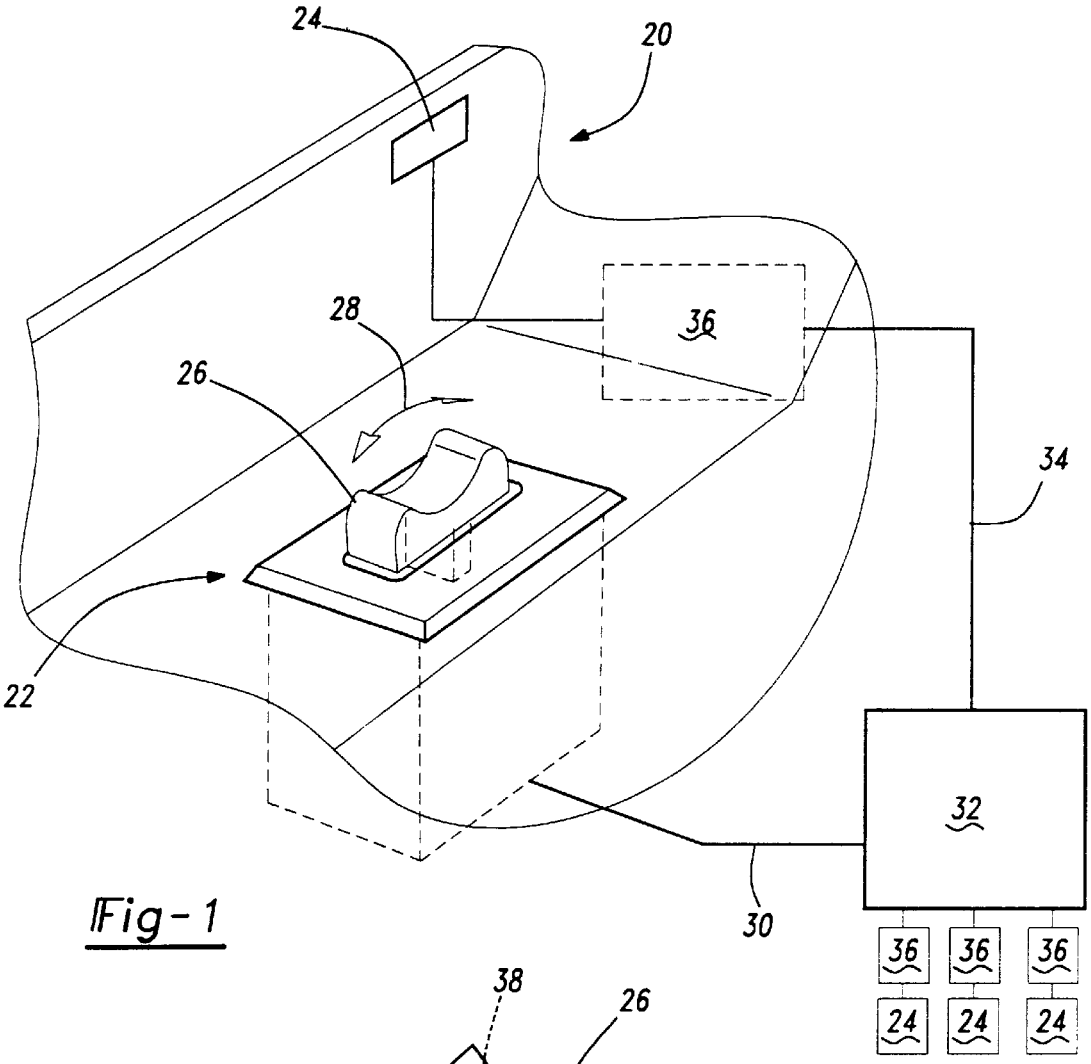
FIG. 1 schematic view of the switching assembly designed according to this invention mounted within a vehicle.

FIG. 1 diagrammatically illustrates a portion of a car door 20 in a vehicle. A switching device 22 is mounted on the door 20. The switching device 22 enables a person sitting next to the device to control the lock condition of a door lock button 24 mounted in each of the doors in the vehicle. Typically both front doors may include the switching device 22. A switch handle 26 is pivotally supported within the switching device 22 so that the switch handle 26 can be manipulated in a fore and aft direction as schematically illustrated by the arrow 28. A first signal cable 30 couples the switching device 22 with an electronic control 32. The electronic control 32 is coupled via a second signal cable 34 to a plurality of door lock modules 36. The door lock modules 36 moves door lock buttons 24 between a locked and an unlocked position. The electronic control 32 is able to detect signal inputs from the switching device 22.

Figure 2:
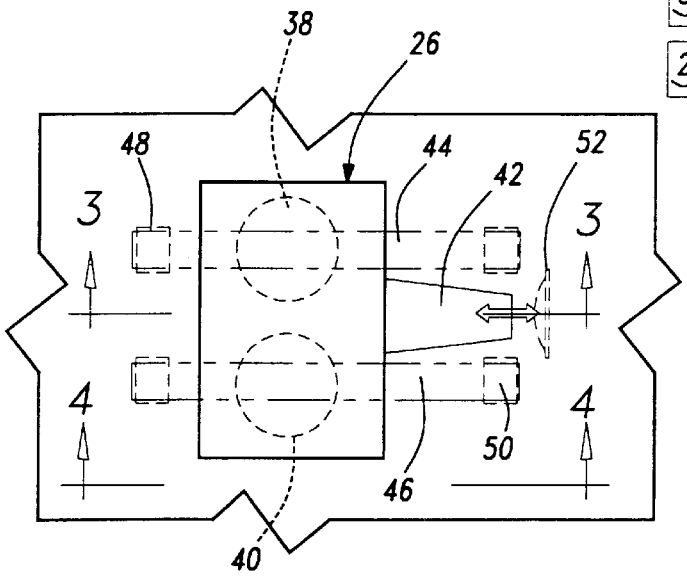
FIG. 2 is a top elevational illustration of selected components of the switching assembly of FIG. 1.

FIG. 2 is a top elevational illustration of selected components of the switching assembly of FIG. 1. The switch structure is similar to that disclosed in co-pending application Ser. No. 08/824,005, entitled "Switching Device With Secondary Switching Function" and filed Mar. 25, 1997. The switch handle 26 includes a first plunger 38, a second plunger 40, and an actuator 42. The two plungers, 38 and 40, serve as actuator portions for actuating a first switch contact 44 and a second switch contact 46, respectively. The first switch contact 44 includes a normally open switch contact end 48 and the second switch contact 46 includes a normally open switch contact end 50. The actuator 42 serves to actuate a flexible conductive member 52 which functions as a third switch contact. The flexible conductive member 52 is flexed outwardly and this third switch contact end is normally open.

Figure 3:
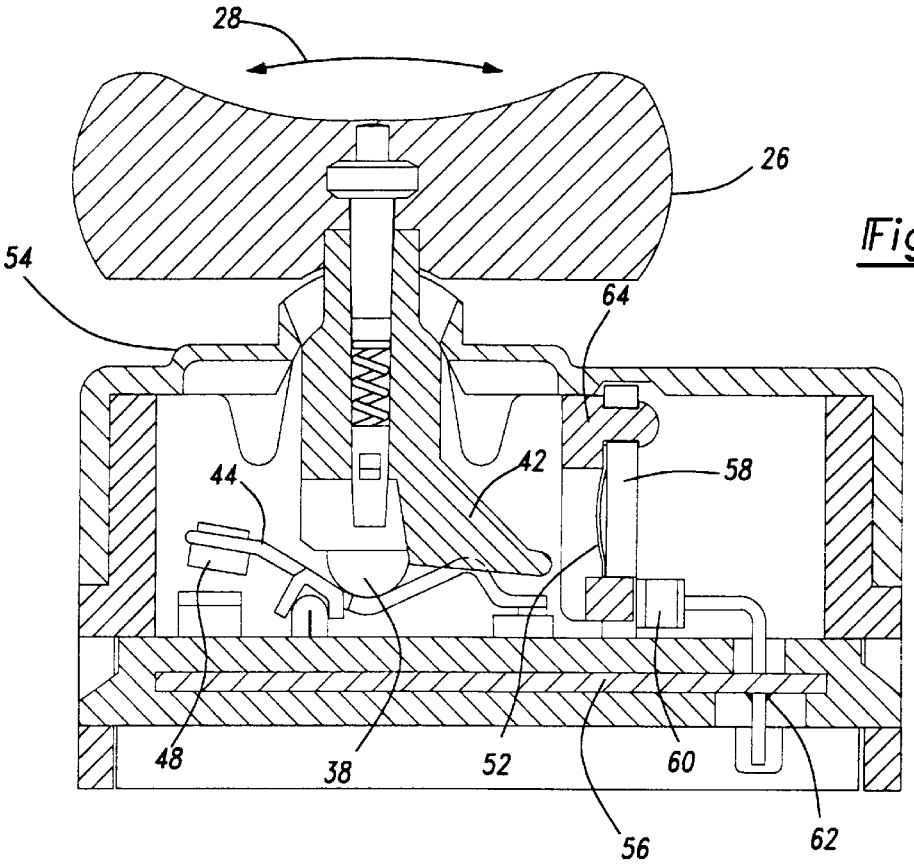
FIG. 3 is a across-sectional illustration taken along the lines 3—3 from FIG. 2 in a neutral position.

FIG. 3 is a cross-sectional illustration taken along lines 3—3 from FIG. 2 and shows the switch handle 26 in its rest or neutral position. In this neutral position switch contact ends 48 and 50 (see FIG. 4), and the flexible conductive member 52 are all open. The switch handle 26 is pivotally mounted in a housing 54. As the switch handle 26 is pivoted fore and aft, schematically illustrated by arrow 28, the first plunger 38 moves along a portion of the surface of the first switch contact 44 and second plunger 40 (see FIG. 4) moves along a portion of the surface of the second switch contact 46. The switching device 22 also includes a circuit plate 56. The switching device 22 further includes a printed circuit board 58 as a signal generator. A header 60 facilitates mounting the printed circuit board 58 in a perpendicular orientation relative to the circuit plate 56. The printed circuit board 58 can be supported by the header 60 alone, or in combination with an inner face between the printed circuit board 58 and other parts of the housing 54. The header 60 facilitates an electrical connection between the printed circuit board 58 and the circuit plate 56. In the presently preferred embodiment, a soldered connection 62 is provided between the printed circuit board 58 and the circuit plate 56. The flexible conductive member 52 is supported adjacent the printed circuit board 58 by a retainer element 64. In the preferred embodiment, the retainer element 64 is a piece of molded plastic. The generally flexible conductive member 52 preferably is a dome-shaped piece of stainless steel.

Figure 4:
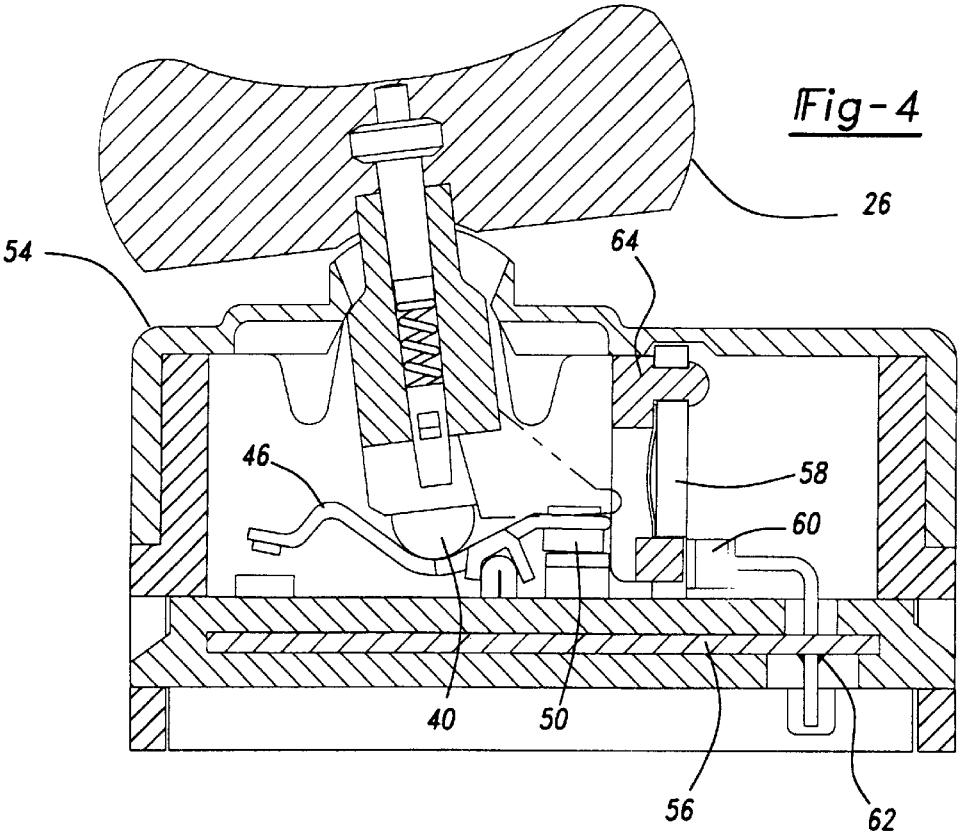
FIG. 4 shows the embodiment of FIG. 3 with the switch handle in a first position.

In FIG. 4 the switch handle 26 is shown rotated to the mid-point of its maximal counterclockwise rotational position. In this position the second plunger 40 is moved sufficiently along second switch contact 46 to cause closure of the switch contact end 50 thereby completing an appropriate circuit within the circuit plate 56. Circuit plate 56 generates an input signal transmitted to the electronic controller 32. The input signal indicates to the electronic control 32 that the user desires to accomplish a switching function. In one embodiment, the input signal generated by closing the switch contact end 50 indicates that the user desires the door lock modules associated with the front doors to unlock the front door lock buttons.

Figure 5:
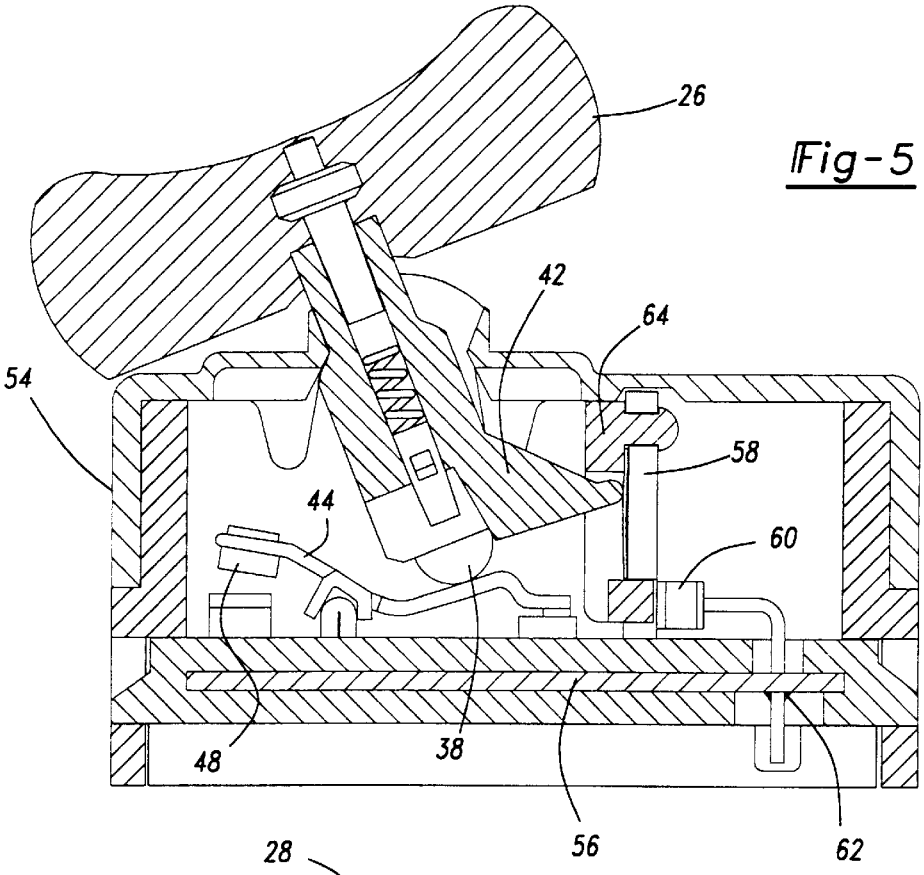
FIG. 5 shows the embodiment of FIG. 3 with the switch handle in a second position

In FIG. 5 the switch handle 26 is shown rotated to its maximal counterclockwise rotational position. In this position the actuator 42 comes into contact with the flexible conductive member 52. A sufficient amount of force placed on the switch handle 26 will result in the actuator 42 causing the central portion of the flexible conductive member 52 to flex toward the printed circuit board 58. When the central portion of the flexible conductive member 52 is flexed sufficiently to contact the printed circuit board 58 a circuit is completed resulting in the printed circuit board 58 generating an input signal transmitted to the electronic controller 32. The input signal indicates to the electronic control 32 that the user desires to accomplish a second switching function. In this embodiment, the input signal generated by the printed circuit board 58 indicates that the operator desires the door lock modules associated with the rear doors to unlock the rear door lock buttons.

Note that in the FIG. 5 position, the contact 50 remains complete, and the switch must travel through the FIG. 4 position to get to FIG. 5. Thus, it is typical that the front doors are unlocked at the FIG. 4 position before the rear doors are unlocked at the FIG. 5 position.

Figure 6:
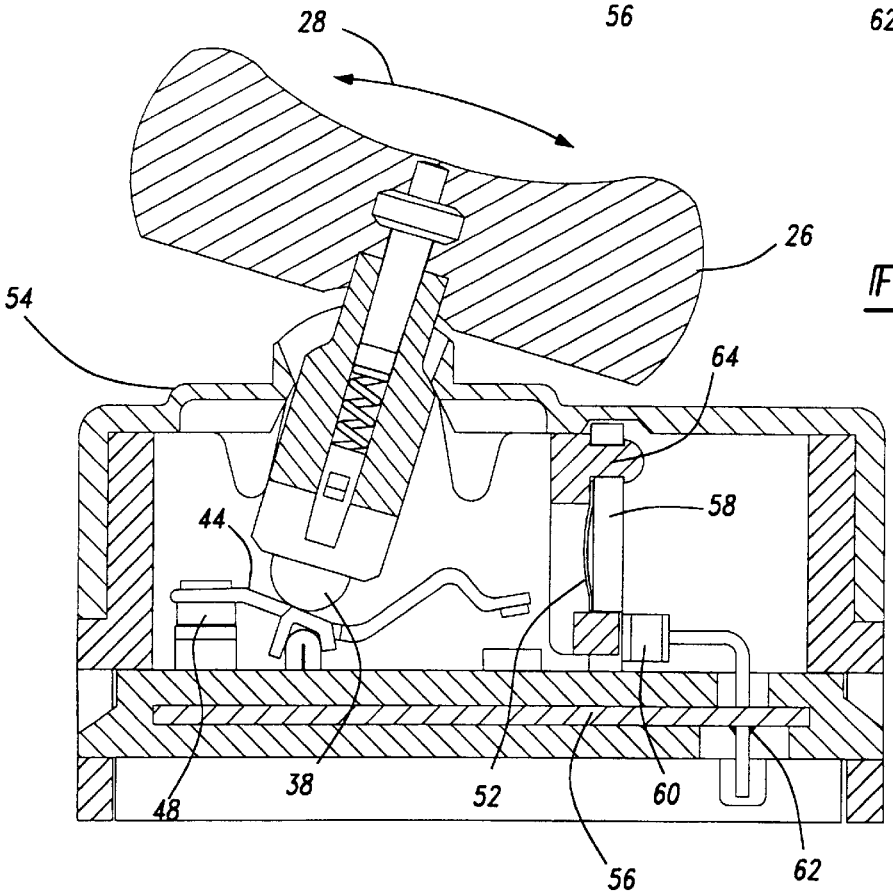
FIG. 6 shows the embodiment of FIG. 3 with the switch handle in a third position.
Figure 7:
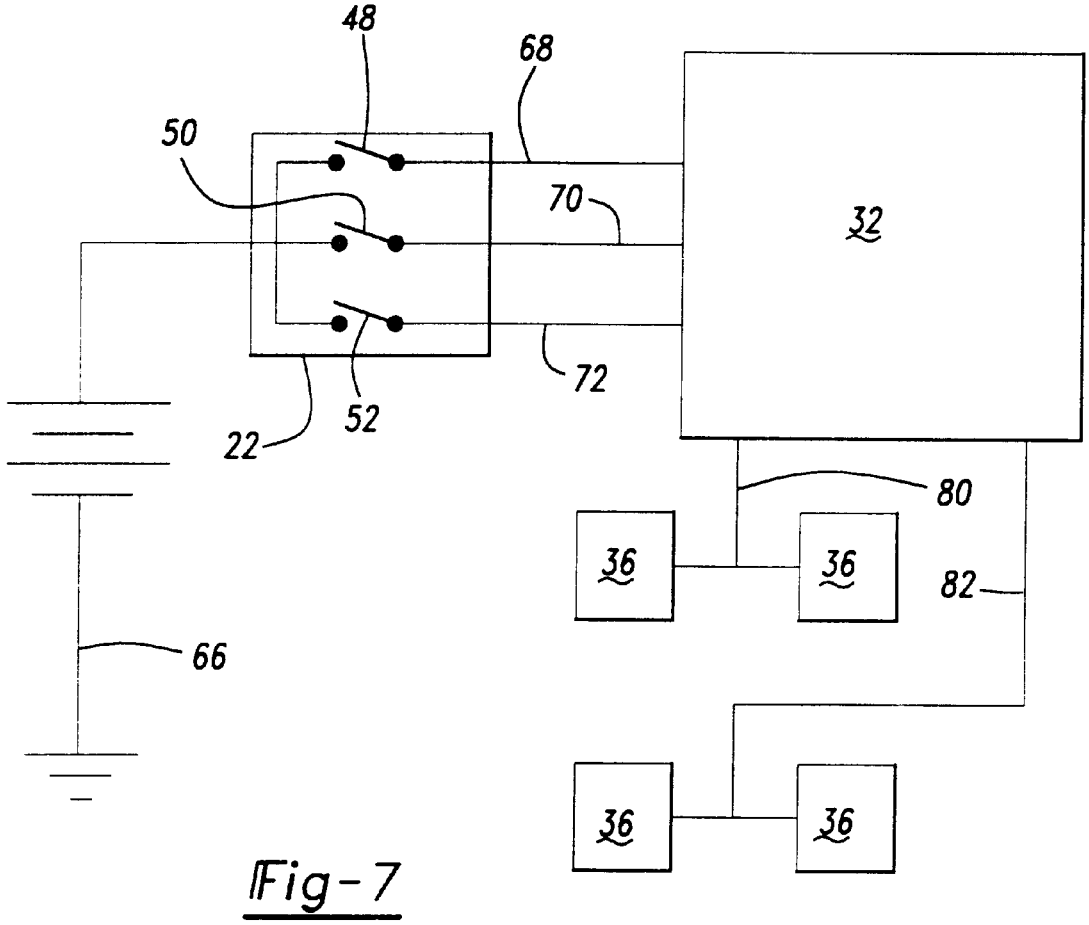
FIG. 7 is a schematic diagram illustrating the electrical connections of this invention.

In FIG. 6 the switch handle 26 is shown rotated to its maximal clockwise position. In this position, first plunger 38 moves along a portion of the surface of the first switch contact 44 a sufficient distance to cause switch contact end 48 to be closed, thereby completing an appropriate circuit within the circuit plate 56. An input signal is then transmitted to the electronic controller 32. The input signal indicates to the electronic control 32 that the user desires to accomplish a third switching function. In this embodiment, the input signal generated by closing the switch contact end 48 indicates that the user desires the door lock modules associated to lock all of the door lock buttons. In FIG. 7 a schematic block diagram generally illustrating the circuitry of the door lock control system is shown. A battery input 66 provides electrical power to the switching device 22. When switch contact end 48, switch contact end 50 or flexible conductive member 52 are closed input signal 68, input signal 70 and input signal 72, respectively, are sent to the electronic control 32. The input signals are detected by the electronic control 32. In the diagram door lock modules for the front driver, front passenger, rear driver, and rear passenger doors are shown at 36. When switch contact end 48 is closed input signal 68 is sent to the electronic control 32 and an output signal is transmitted from the electronic control 32 and sent only through a front door lock cable 80 and a rear door lock cable 82 to cause door lock modules 36 to lock their associated door lock buttons. When switch contact end 50 is closed input signal 70 is sent to the electronic control 32 and an output signal is transmitted from the electronic control 32 and sent through the front door lock cable 80 to cause front door lock modules 36 to unlock their associated door lock buttons. When the flexible conductive member 52 is flexed sufficiently to contact the printed circuit board 58, output signal 72 is sent to the electronic control 32 and an output signal is transmitted from the electronic control 32 and sent through the rear door lock cable 82 to cause rear door lock modules 36 to unlock their associated door lock buttons.

Alternatively, one of the two unlock positions can be an all door unlock signal, with the other signal unlocking only a selected subset of doors. The switch disclosed in this application is exemplary, as are the switch positions and the respective signals. Other type switches come within the scope of this invention.

A door lock control designed according to this invention provides the advantages of simplifying and reducing the number of components required to accomplish selective control of the door locks for the plural doors of a vehicle.

The foregoing description is exemplary rather than limiting in nature. Variations and modifications to the disclosed embodiment may become apparent to those skilled in the art and do come within the scope of this invention. Accordingly, the scope of legal protection afforded this invention can only be determined by studying the following claims.

We claim:

1. A method for selectively controlling the lock condition of a plurality of doors from inside a vehicle, said method comprising the steps of:

locating inside a vehicle a control having a user manipulatable switch handle and three contacts, said control capable of sending a set of at least three distinct input signals based on the position of said switch handle, a first of said input signals associated with locking all of said doors, a second of said input signals associated with unlocking only a first portion of said doors and with a second portion of said doors remaining locked, and a third of said input signals associated with unlocking only said second portion of said doors, said second portion not including any of said doors in said first portion;

providing each of said doors with a door lock module capable of both locking and unlocking said door;

manually moving said switch handle from inside the vehicle from a rest position into engagement with one of three contact positions thereby selecting one of said three distinct input signals whereby movement from a second of said contact positions to a third of said contact positions engages said switch handle with both said second contact position and said third contact position;

transmitting the selected input signal to at least one of said door lock modules thereby locking each of said doors if said first signal is selected, unlocking said first portion of said doors and leaving said second portion of said doors locked if said second signal is select, and unlocking said second portion of said doors if said third signal is selected.

2. The method as set forth in claim 1, wherein moving said switch handle from a rest position to one of said contact positions includes the step of moving said switch handle a first direction a first distance to select said first of said input signals, moving said switch handle a second direction a first distance to select said second of said input signals, and moving said switch handle said second direction a second distance wherein said second distance is further than said first distance in said second direction to select said third of said input signals.

3. The method as set forth in claim 1, wherein the method further includes the step of providing an electronic control capable of detecting and distinguishing each of said input signals, said electronic control detecting an input signal and then transmitting one of a plurality of corresponding output signals to at least one of said door lock modules to thereby lock or unlock the associated door based on said input signal.

4. A door lock control system for selectively controlling the lock condition of a plurality of doors from inside a vehicle, each door having a door lock and a door lock module, said system comprising:

a set of at least three switch contacts mounted in a single switch mechanism, an electronic control, an electrical power supply, and at least one user manipulatable switch handle for selecting between said switch contacts;

said switch handle comprising a first plunger, a second plunger, and an actuator;

said first plunger engaging a first of said switch contacts when said switch handle is moved a first direction a first distance to thereby selectively couple said first switch contact with said power supply to send a first input signal to said electronic control, said second plunger engaging a second of said switch contacts when said switch handle is moved a second direction a first distance thereby selectively coupling said second switch contact with said power supply to send a second input signal to said electronic control, said actuator engaging a flexible conductive member when said switch handle is moved said second direction a second distance, wherein said second distance is further than said first distance of said second direction to thereby selectively couple a signal generator with said power supply to send a third input signal to said electronic control;

said electronic control for detecting said input signals sent from each of said switch contacts and for transmitting one of a plurality of output signals to each of the door lock modules of the doors;

said first input signal and a first of said output signals for being transmitted to the door lock modules of each of the doors for locking all of the doors;

said second input signal and a second of said output signals being transmitted to only a first set of door lock modules thereby unlocking each door associated with the first set of door lock modules but not all doors being unlocked by said second output signal;

said third input signal and a third of said output signals being transmitted to a second set of the door lock modules thereby unlocking each door associated with the second set of door lock modules.

5. A door lock control system as set forth in claim 4, wherein said input signals are electrical signals.

6. A door lock control system as set forth in claim 4, wherein said output signals are electrical signals.

7. A door lock control system as set forth in claim 4, wherein said signal generator is a printed circuit board and wherein movement of said single switch handle said second direction flattens said flexible conductive member to thereby selectively couple said circuit board with said power supply.

8. A vehicle door lock system for controlling the lock condition of the doors from inside a vehicle, said vehicle door lock system comprising:

a plurality of doors each having a door lock and a door lock module;

a switching module mounted interior to one of said doors and comprising at least three switch contacts, an electronic control, a power supply, and at least one user manipulatable switch handle mounted to said switching module for selecting between said at least three switch contacts, said switch handle including a first plunger for engaging a first switch contact and a second plunger for engaging a second switch contact and an actuator for engaging a third switch contact, said electronic control for detecting input signals sent from each of said switch contacts and for transmitting one of a plurality of output signals to each of said door lock modules of said doors, a first of said input signals and a first of said output signals being transmitted to said door lock modules of each of said doors causing locking of all said doors, a second of said input signals and a second of said output signals being transmitted to only a first set of said door lock modules thereby unlocking doors associated with said first set of said door lock modules, with not all of said doors being unlocked by said second output signal, and a third of said input signals and a third of said output signals being transmitted to a second set of said door lock modules thereby unlocking each said door associated with said second set of door lock modules, said first and second set of door lock modules containing at least some door lock modules which are not common.

9. A vehicle door lock system as set forth in claim 8, wherein said second output signal causing unlocking of only front doors, and said third output signal causing unlocking of only rear doors.

* * * * *